US007172313B2

(12) United States Patent
Abel et al.

(10) Patent No.: US 7,172,313 B2
(45) Date of Patent: Feb. 6, 2007

(54) TOUCH SENSITIVE FLASHLIGHT

(75) Inventors: Jeremy Aaron Abel, Roselle, IL (US); Satyajit Deb, Bolingbrook, IL (US); Thomas Michael McKeon, Wheaton, IL (US); Steven Michael Schennum, Plainfield, IL (US); Craig Allen White, Chicago, IL (US)

(73) Assignee: Creata Retail (HK) Limited, Hong Kong (HK)

( * ) Notice: Subject to any disclaimer, the term of this patent is extended or adjusted under 35 U.S.C. 154(b) by 177 days.

(21) Appl. No.: 11/049,022

(22) Filed: Feb. 2, 2005

(65) Prior Publication Data

US 2006/0171142 A1 Aug. 3, 2006

(51) Int. Cl.
*F21L 4/04* (2006.01)
*F21V 23/04* (2006.01)

(52) U.S. Cl. ..... 362/205; 362/200; 200/60

(58) Field of Classification Search ..... 362/157, 362/200, 205; 200/60; 315/22 R; 307/139
See application file for complete search history.

(56) References Cited

U.S. PATENT DOCUMENTS 5,158,356 A * 10/1992 Guthrie ..... 362/188
5,455,749 A 10/1995 Ferber
5,463,539 A * 10/1995 Vandenbelt et al. ..... 362/189
5,685,632 A 11/1997 Schaller et al.
5,893,631 A * 4/1999 Padden ..... 362/201
5,973,420 A 10/1999 Kaiserman et al.
6,006,562 A * 12/1999 Wolter ..... 70/456 R
6,054,156 A 4/2000 Rudell et al.
6,140,776 A 10/2000 Rachwal
6,239,555 B1 5/2001 Rachwal
6,299,323 B1 * 10/2001 Yu et al. ..... 362/116
6,388,390 B2 5/2002 Rachwal
6,802,624 B2 10/2004 Maglica

* cited by examiner

*Primary Examiner*—Ali Alavi
(74) *Attorney, Agent, or Firm*—D. Peter Hochberg; Sean Mellino

(57) ABSTRACT

A flashlight having a non-conductive housing, an electric power source, a light source, and two nodes disposed on external surfaces of the non-conductive housing, wherein the flashlight is adapted to allow electric current to flow from the power source through the light source when both of the two nodes are abutted by a user's hand, activating the flashlight without further manipulation required by the user. Inadvertent activation of the flashlight is minimized by including a protruding rib between the nodes or by disposing the nodes on different sides of the flashlight.

43 Claims, 4 Drawing Sheets

TOUCH SENSITIVE FLASHLIGHT

BACKGROUND OF THE INVENTION

1. Field of the Invention

The present invention relates to portable lighting devices such as floodlights, flashlights, key-chain lights and laser pointers and in particular relates to portable lighting devices having touch sensitive activation. While the present invention relates to all portable lighting devices, reference will be made throughout this specification to the preferred embodiment of a flashlight by way of example only.

2. Prior Art

It is known in the art to use manual switches such as pushbuttons, sliding switches, and the like to turn flashlights on and off. Since their inception, flashlights have incorporated manual switches that require manipulation by the user's fingers. In recent years, flashlights and other lights have been developed in the art to create touch sensitive "switches" from exposed terminals of an open circuit intended to be electrically bridged through the conductive medium of some portion of a user's body. For example, U.S. Pat. No. 6,388,390 (Rachwal) provides a flashlight that has two touch sensitive switches, either of which can be bridged by a user's finger. The patent describes how the user presses a finger against the exposed terminals to control the intensity of light emitted. Rachwal describes a touch sensitive switch apparatus that includes first and second terminals, which are engaged by the user to increase the intensity of the light. In addition, third and fourth terminals are engaged by the user to decrease the intensity of the light.

Other prior art discloses touch sensitive trigger circuits where conductive terminals are used as part of a switch or "trigger point". U.S. Pat. No. 5,973,420 (Kaiserman) and U.S. Pat. No. 5,455,749 (Ferber) describe a wide range of electrical devices that utilize conductive compositions that may be painted, printed, screened, coated, or otherwise applied to non-conductive articles, creating circuitry on the surface of those articles. Both patents describe leaving open circuit "trigger points" in the circuitry that can be electrically bridged by a user's finger or other conductive objects. This electrical bridging activates LEDs, sound modules, or other responsive circuit elements.

U.S. Pat. No. 5,685,632 (Schaller) describes using conductive plastic to form selected portions of a flashlight such as battery housings or tailcaps in order to simplify construction. While Schaller is not directed to touch sensitive activation, the flashlight and conductive plastics described are relevant prior art.

The abovementioned prior art flashlights are awkward to use. Inevitably, the user must pick the flashlight up, then rotate the flashlight around, find and actuate the activation switch. While prior art flashlights with touch sensitive switches have advantages over mechanical switches, the user must still rotate the flashlight, find the touch sensitive switch, and then push it. In some instances, touch sensitive switches exacerbate the problem because they may be harder to locate than protruding mechanical switches. Indeed, devices taught by Kaiserman specifically use clear conductive composites to create "magical or mysterious" trigger points. Likewise, U.S. Pat. No. 6,054,156 (Rudell) describes novelty items that mysteriously activate a light or sound when a user uses the novelty item. The novelty items have small nodes bridged via some intermediary substance such as a drink or frozen drink. Once bridged, the completed circuit includes: the first node, the drink, the user's mouth body and hand, and then to a second node. The novelty item 'mysteriously' generates a light or sound when the user licks the frozen drink, providing that one of their hands is also properly abutted against the electrical node.

The open circuit nodes of touch sensitive switches described above are taught to be small, because they are particularly susceptible to inadvertent activation by accidentally making contact with other objects. Additionally, touch sensitive circuit nodes are typically close to each other and on a substantially flat surface, such that a single finger may bridge the gap, which inevitably raises the likelihood of inadvertent activation.

Locating the activation switch in prior art flashlights is particularly problematic in that the reason the user usually needs the flashlight is that only limited ambient light exists. In use, it is often too dark to visually locate the flashlight, let alone find the activation switch. Even when a user can find the activation switch, there is a certain level of dexterity that is assumed in being able to manually manipulate the switch. Elderly users or users suffering from arthritis, for example, can be considerably challenged by finding and merely placing a finger onto a touch sensitive switch.

The most able users have also traditionally been frustrated by having to activate prior art flashlights. For example, consider a mechanic who has only one hand available to manipulate a flashlight but picks it up with the activation switch on the wrong side. Worse yet are prior art flashlights requiring two hands to activate, for example by twisting one portion of the flashlight relative to another, such as commonly used by police and military forces, for example as described in U.S. Pat. No. 6,802,624 (Maglica). The problems of activating flashlights of the prior art can become serious during emergency situations where valuable time can be wasted in nervously trying to find and manipulate a flashlight's activation switch.

The present invention seeks to provide a portable lighting device that will ameliorate or overcome at least one of the deficiencies of the prior art.

BRIEF SUMMARY OF THE INVENTION

In a first aspect the present invention consists of a portable lighting device comprising:

a non-conductive housing having at least one rib protruding outward from said non-conductive housing;

an electric power source;

a light source adapted to illuminate when electric current flows through said light source;

two spaced apart nodes disposed on external surfaces of said non-conductive housing adjacent to and on either side of said rib, wherein said rib protrudes beyond said two spaced apart nodes such that a linear portion of an object can not simultaneously contact both of said two spaced apart nodes;

said portable lighting device adapted to allow electric current to flow from said power source through said light source when said two spaced apart nodes are both abutted by a user's hand as said user grasps said portable lighting device.

Preferably, each of said two spaced apart nodes is comprised of an array of traces disposed on the surface of, and electrically connected by connections disposed internal to, said non-conductive housing, and wherein one of said at least one rib is disposed between proximate traces of said two spaced apart nodes to minimize inadvertent activation of said portable lighting device.

Preferably, each of said two spaced apart nodes are disposed on different graspable sides of said non-conductive housing, such that said two spaced apart nodes are abutted from different directions by said user's hand as it surrounds and grasps said portable lighting device.

Preferably, said two spaced apart nodes are disposed along the normal grasping position of said non-conductive housing, such that when said user places said user's hand in said normal grasping position, said user's hand abuts said two spaced apart nodes without further manipulation required to activate said portable lighting device.

Preferably, said rib is disposed axially along said portable lighting device.

Preferably, said two spaced apart nodes are disposed about an area that extends over at least 5%, more preferably over at least 20%, even more preferably over at least 40%, even more preferably over at least 60%, and most preferably over at least 80% of said non-conductive housing.

Preferably, at least one of said two spaced nodes is disposed about an area that extends over a substantial portion of the axial length of said non-conductive housing. More preferably, said area extends over at least 60% and most preferably over at least 70% of the axial length of said non-conductive housing.

Preferably, the outer surfaces of said two spaced apart nodes form a plurality of gripping ridges.

Preferably, said two spaced apart nodes are compliant grips of said portable lighting device.

In a first main preferable embodiment, said two spaced apart nodes are conductive and said portable lighting device is adapted to allow electric current to flow from said power source through said light source when said two spaced apart nodes are electrically bridged through the conductive medium of said user's hand as said user grasps said portable lighting device.

In one preferable embodiment, said two spaced apart nodes are made from a conductive material and subsequently affixed to said external surfaces of said non-conductive housing. More preferably, said conductive material is a conductive metal.

In an alternative preferable embodiment, said two spaced apart nodes are made from a conductive composition applied to said external surfaces of said non-conductive housing. More preferably, said conductive composition is a conductive ink.

Preferably, a control circuit allows electric current to flow from said power source through said light source when said two spaced apart nodes are electrically bridged. Preferably, said control circuit allows electric current to flow from said power source through said light source when said two spaced apart nodes are electrically bridged by a conductive medium having at least a predetermined minimum resistance. More preferably, said predetermined minimum resistance is lower than the resistance through a wet human hand and higher than the resistance through a metallic conductor.

Preferably, said control circuit automatically prevents electric current from flowing from said power source through said light source when a predetermined shutdown condition is determined by said control circuit. More preferably, said predetermined shutdown condition is that said two spaced apart nodes have been continuously electrically bridged for longer than a predetermined time interval.

Preferably, said portable lighting device further comprises at least one auxiliary node disposed on an external surface of said non-conductive housing. In one preferred embodiment, said control circuit allows said user to vary the light intensity of said portable lighting device by electrically bridging said at least one auxiliary node with at least one node selected from: said two spaced apart nodes and further auxiliary nodes. In a further preferred embodiment, said control circuit allows said user to select between continuous activation and strobe activation of said portable lighting device by electrically bridging said at least one auxiliary node with at least one node selected from: said two spaced apart nodes and further auxiliary nodes.

Preferably, said portable lighting device further comprises at least one conventional mechanical means movable between a first and at least a second position, wherein said control circuit determines the operating state of said portable lighting device based on said conventional mechanical means when said portable lighting device is activated.

In a second main preferable embodiment, said two spaced apart nodes are made from touch sensitive film and said portable lighting device is adapted to allow electric current to flow from said power source through said light source when said user's hand grasps both of said two spaced apart nodes.

Preferably, a control circuit allows electric current to flow from said power source through said light source when pressure is exerted on both of said two spaced apart nodes.

Preferably, said control circuit automatically prevents electric current from flowing from said power source through said light source when a predetermined shutdown condition is determined by said control circuit. More preferably, said predetermined shutdown condition is that pressure has been exerted on both of said two spaced apart nodes continuously for longer than a predetermined time interval.

Preferably, said portable lighting device further comprises at least one auxiliary node disposed on an external surface of said non-conductive housing. In one preferable embodiment, said control circuit allows said user to vary the light intensity of said portable lighting device by exerting pressure on said at least one auxiliary node. In an alternative preferable embodiment, said control circuit allows said user to select between continuous activation and strobe activation of said portable lighting device by exerting pressure on said at least one auxiliary node.

Preferably, said portable lighting device further comprises at least one conventional mechanical means movable between a first and at least a second position, wherein said control circuit determines the operating state of said portable lighting device based on said conventional mechanical means when said portable lighting device is activated.

In a first preferable embodiment, said portable lighting device is a flashlight.

In a second preferable embodiment, said portable lighting device is a key-chain light.

In a third preferable embodiment, said portable lighting device is a laser pointer.

Preferably, said portable lighting device is rechargeable.

In a second aspect the present invention consists of a portable lighting device comprising:

a non-conductive housing;

an electric power source;

a light source adapted to illuminate when electric current flows through said light source;

two spaced apart nodes disposed on different spaced apart external surfaces of said non-conductive housing such that said two spaced apart nodes are abutted from different directions by a user's hand as it surrounds and grasps said portable lighting device;

said portable lighting device adapted to allow electric current to flow from said power source through said light source when said two spaced apart nodes are abutted by said user's hand as said user grasps said portable lighting device activating said portable lighting device without further manipulation required by said user.

In a third aspect the present invention consists of a portable lighting device comprising:

a non-conductive housing;

an electric power source;

a light source adapted to illuminate when electric current flows through said light source;

two nodes disposed on external surfaces of said non-conductive housing;

said portable lighting device adapted to allow electric current to flow from said power source through said light source when both of said two nodes are abutted by a user's hand, and wherein whenever said user grasps said portable lighting device, both of said two nodes are abutted, activating said portable lighting device without further manipulation required by said user.

BRIEF DESCRIPTION OF THE DRAWINGS

Preferred embodiments of the invention will now be described, by way of example only, with reference to the accompanying drawings in which.

DETAILED DESCRIPTION OF THE INVENTION

Figure 1:
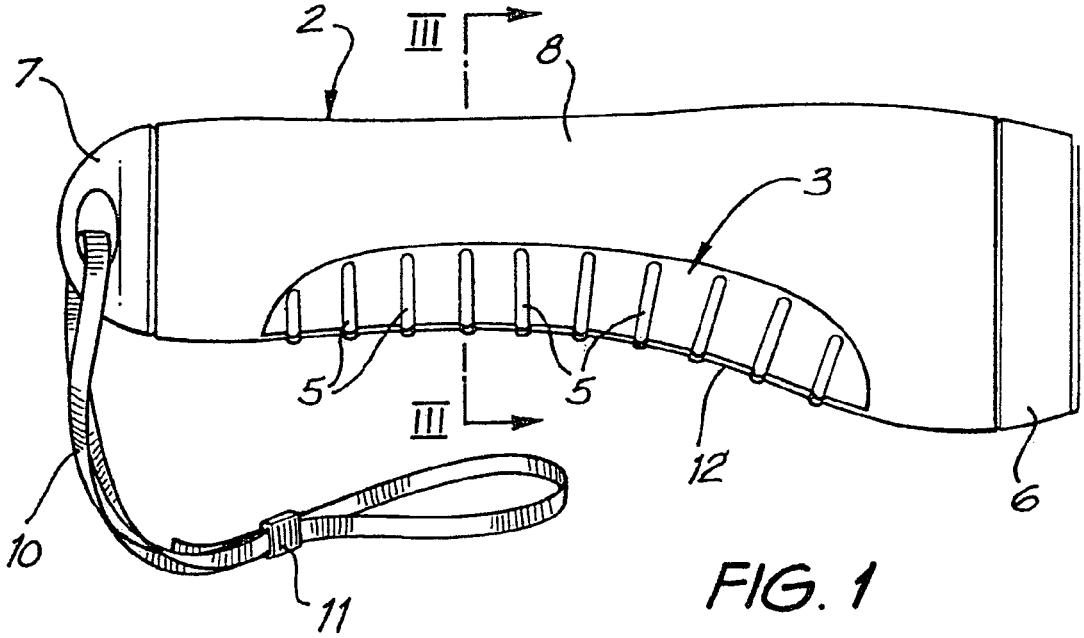
FIG. 1 is a side view of a flashlight according to a first embodiment of the present invention.

Referring to the figures, the preferred embodiment of the present invention is depicted in flashlight 1, which comprises non-conductive housing 2, batteries 13, light bulb 17, and first and second nodes 3 and 4. Non-conductive housing 2 provides the body of flashlight 1 and comprises lens ring 6, first and second side portions 8 and 9, rib 12, and end cap 7. First and second nodes 3 and 4 are disposed adjacent to and on either side of rib 12. When first and second nodes 3 and 4 are electrically bridged, electric current is allowed to flow from batteries 13 through light bulb 17, thereby activating flashlight 1. In use, first and second nodes 3 and 4 are electrically bridged by a user's hand when the user grasps flashlight 1. The protrusion provided by Rib 12 minimizes inadvertent activation of flashlight 1 by preventing linear portions of conductive objects like screwdrivers and the like from simultaneously contacting both first and second nodes 3 and 4.

First and second nodes 3 and 4 are fabricated from a conductive rubber, such as silicon rubber with carbon additive, and simultaneously act both as compliant grips and activation switch of flashlight 1. First and second nodes 3 and 4 each preferably comprise one continuous conductive pad. First and second conductive nodes 3 and 4 are disposed about an area that extends over external surfaces of non-conductive housing 2.

To aid the user in positively gripping flashlight 1, a plurality of gripping ridges 5 are disposed circumferentially about first and second nodes 3 and 4. Rib 12 has a matching plurality of gripping ridges, which are non-conductive. To aid the user in visually distinguishing first and second nodes 3 and 4 as compliant grips, first and second node 3 and 4 differ in appearance from non-conductive housing 2. For example, first and second nodes 3 and 4 may be of a different, or darker, color. The size, shape, location, color and material of first and second nodes 3 and 4 give them the dual functions of grip and electrical contact nodes.

Figure 2:
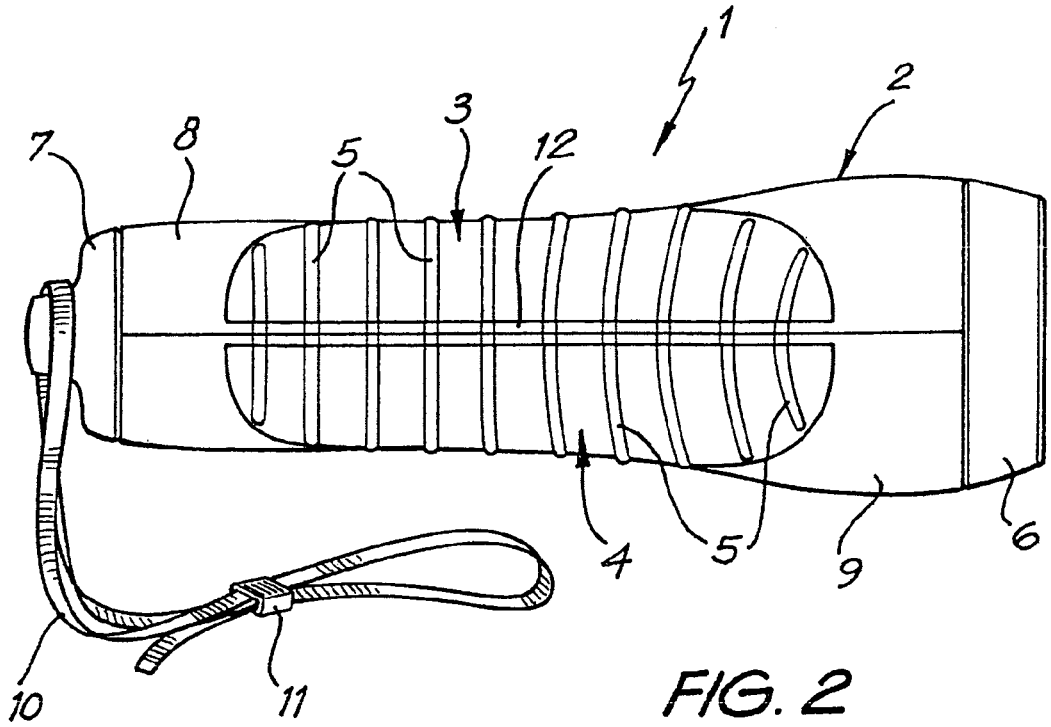
FIG. 2 is a bottom view of the flashlight shown in FIG. 1.

FIGS. 1 and 2 depict side and bottom views of flashlight 1, showing rib 12 protruding outward beyond first and second nodes 3 and 4. These views best show the relative size of first and second nodes 3 and 4 to non-conductive housing 2. First and second nodes 3 and 4 are disposed about an area that is large enough that the user's hand will electrically bridge them when grasping flashlight 1. To raise the likelihood that the user's hand will contact first and second nodes 3 and 4 when the user first grasps flashlight 1, first and second nodes 3 and 4 are disposed about an area that extends over at least 5%, more preferably about 20% to 90%, and most preferably about 20% to 40% of non-conductive housing 2. The larger the area about which first and second nodes 3 and 4 extend, the higher the likelihood that the user's hand will contact them when grasping flashlight 1. Advantageously, first and second nodes 3 and 4 are disposed about an area that extends over a substantial portion, preferably at least 60% and more preferably at least 70% of the axial length of non-conductive housing 2. Disposing first and second nodes along a substantial portion of the axial length of flashlight 1 raises the probability that the user's hand will contact them when the user grips flashlight 1.

Large first and second nodes 3 and 4 are particularly advantageous for users with limited dexterity or during emergencies. Even before grasping flashlight 1, the large first and second nodes 3 and 4 are likely to be electrically bridged by the user's hand as the user searches for flashlight 1, for example in a drawer of tools. However, first and second nodes 3 and 4 are preferably still small enough to allow flashlight 1 to be held without necessarily abutting both first and second nodes 3 and 4. For example, when the user wishes to transport flashlight 1 without activating it, the user is able to grasp first and second side portions 8 and 9 without electrically bridging both first and second nodes 3 and 4. To further assist carrying flashlight 1, lanyard 10 with lanyard adjuster 11 is attached to end cap 7. Lanyard 10 allows the user to hang flashlight 1 from the user's wrist and thus avoiding contact with nodes 3 and 4.

In addition to being large, first and second nodes 3 and 4 are disposed along the normal grasping position of non-conductive housing 2, which further raises the likelihood that flashlight 1 will be activated when the user picks it up. Normal grasping position is a grasping position where the user's fingers wrap around to gripping ridges 5 with the user's palm abutting the remaining smooth portion of non-conductive housing 2. A user's hand is not required, however, to be in the normal grasping position to activate flashlight 1. For example, if the user picks up flashlight 1 with their palm abutting first and second nodes 3 and 4, the nodes will still be electrically bridged. As a result of the size and location of first and second nodes 3 and 4, flashlight 1 activates when grasped, without having to subsequently find and manipulate any switches or touch sensitive buttons with further individual finger movements. Advantageously, the user immediately learns how to operate flashlight 1 without investigation because flashlight 1 activates when a user first grips it.

Figure 3:
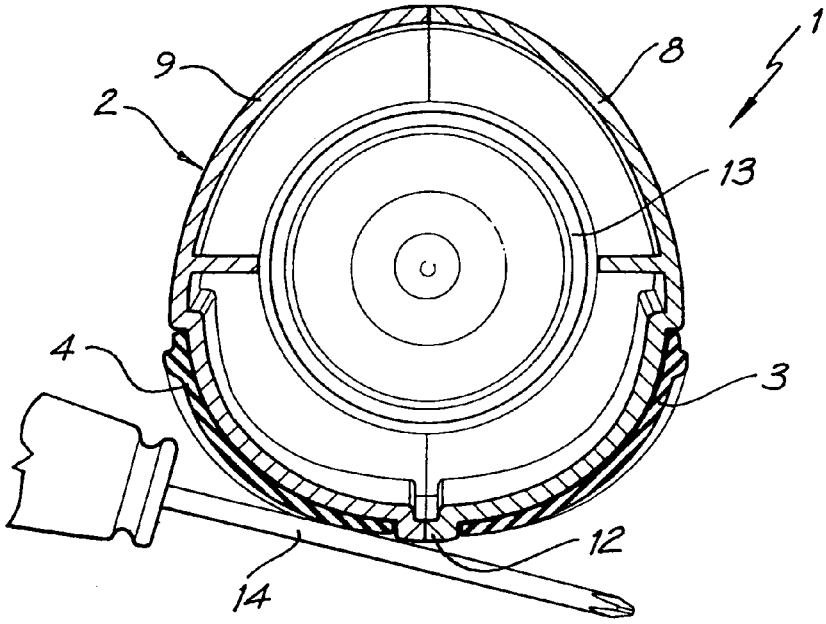
FIG. 3 is a cross-section view through line III—III in FIG. 1.

FIG. 3 depicts a cross-section end view through flashlight 1 and battery 13. This view shows first and second nodes 3 and 4 disposed on external surfaces of non-conductive housing 2. Rib 12 is formed from protruding non-conductive portions of first side portion 8 and second side portion 9 of non-conductive housing 2. Rib 12 protrudes outward beyond and intermediate first and second nodes 3 and 4, isolating them from each other. Rib 12 prevents a linear portion of a conductive object, for example screwdriver 14, from simultaneously making contact with both first and second conducting nodes 3 and 4, which would otherwise inadvertently activate flashlight 1. While a curved conductive object such as a fork, or several conductive objects may still act in combination to inadvertently electrically bridge first and second nodes 3 and 4, rib 12 reduces the likelihood of such an inadvertent activation of flashlight 1. Susceptibility to inadvertent activation has largely limited the usefulness of prior art touch sensitive devices. By limiting the susceptibility of flashlight 1 to inadvertent activation, rib 12 allows for large first and second nodes 3 and 4.

Figure 4:
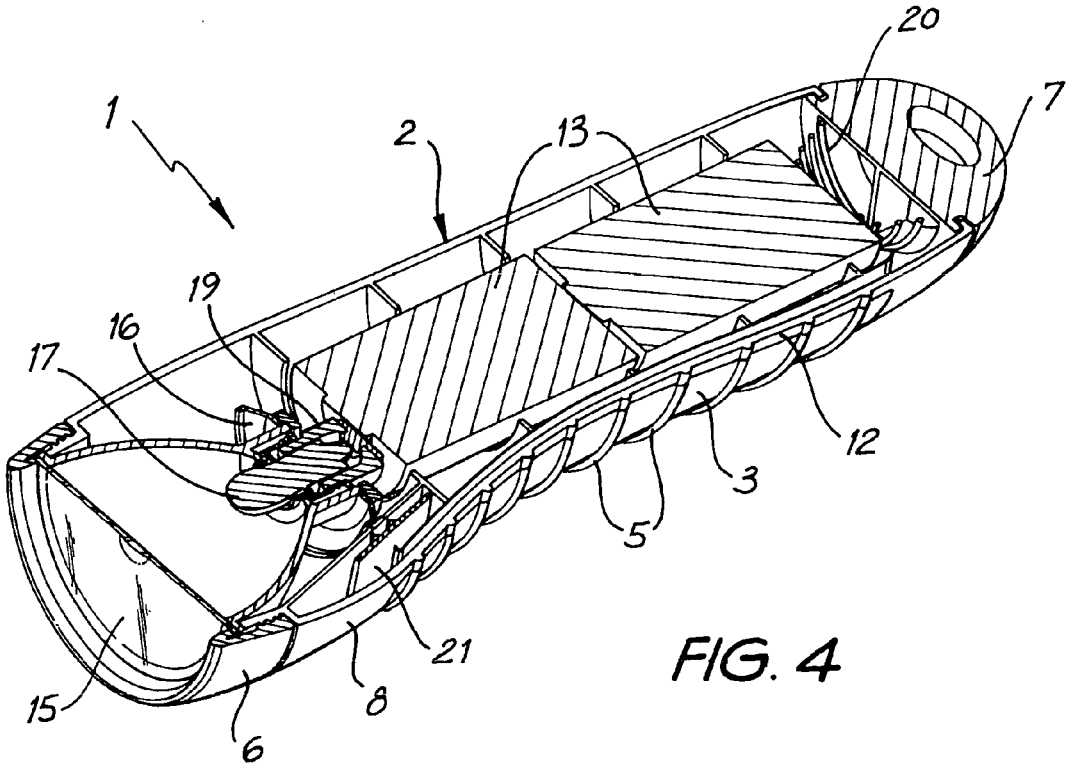
FIG. 4 is a cut away perspective view of the flashlight shown in FIG. 1.

FIG. 4 depicts a cross-section side view through flashlight 1 and batteries 13. This view will be used to explain how flashlight 1 works. When control circuit 21 senses that first and second nodes 3 and 4 are electrically bridged, electric current is allowed to flow through the following circuit: batteries 13, light bulb 17, contact shell 16, control circuit 21, bottom spring 20 and back to batteries 13. Control circuit 21 is an integrated circuit on a printed circuit board (PCB) and utilizes known switching circuitry to allow electric current to flow from batteries 13 through light bulb 17. First and second nodes 3 and 4 make direct contact with terminals of circuit 21. Smaller interconnecting conductive elements, such as wires, traces, contact washers and the like have not been shown for clarity purposes and are implemented by known methods in known configurations. Some of the interconnecting conductive elements could be made from conductive compositions such as described in U.S. Pat. No. 5,973,420.

Figure 5:
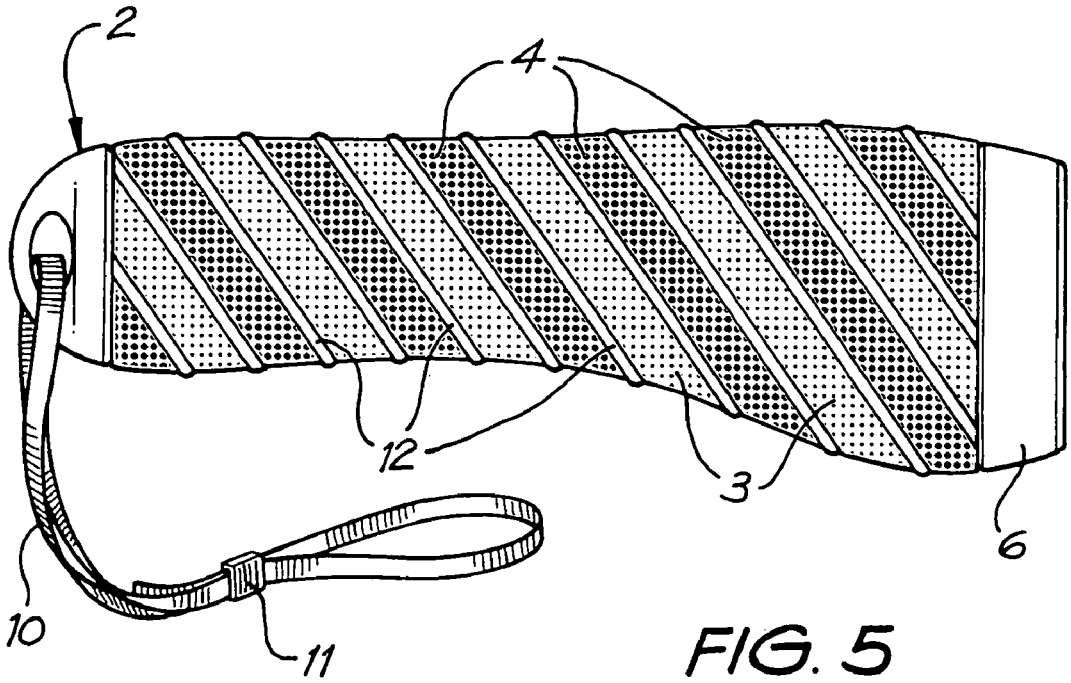
FIG. 5 is a side view of a flashlight according to a second embodiment of the present invention.
Figure 6:
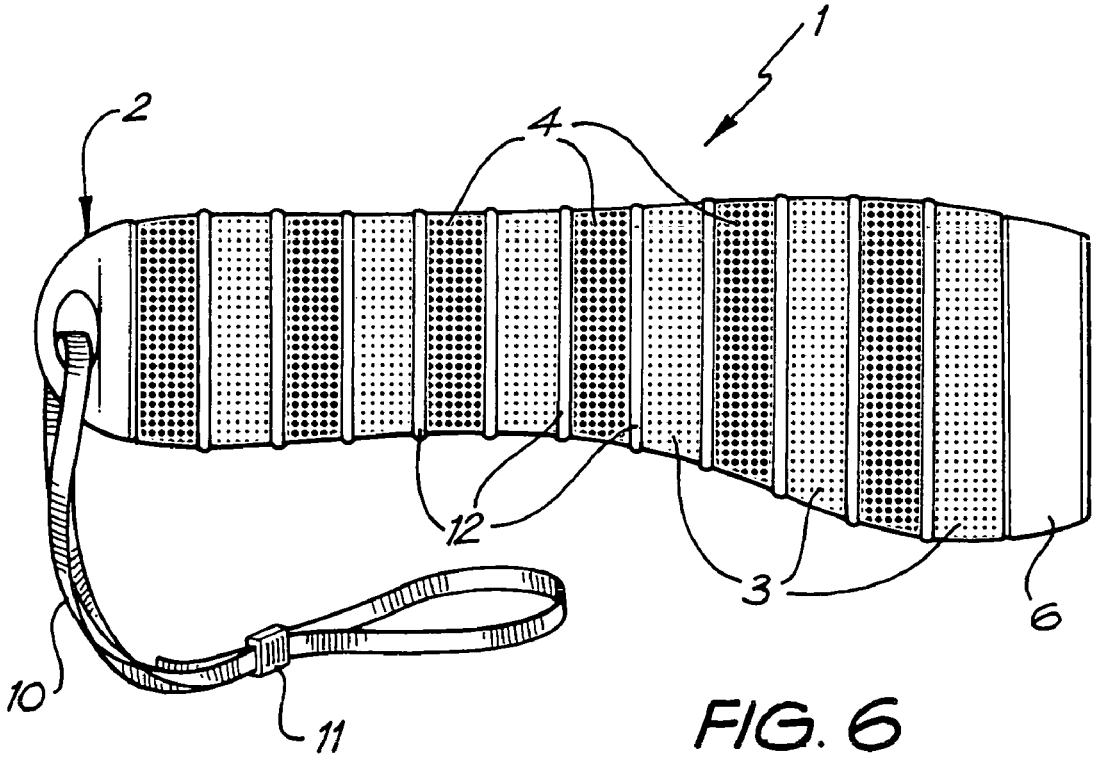
FIG. 6 is a side view of a flashlight according to a third embodiment of the present invention.

FIGS. 5 and 6 show further embodiments of the present invention wherein first and second nodes 3 and 4 each consist in an array of electrically connected traces. In FIG. 6, first node 3 includes six separate traces, each circumferentially disposed around non-conductive housing 2. Likewise, second node 4 includes six circumferentially disposed separate traces. The traces making up each node are electrically connected below the surface of non-conductive housing 2. Where the traces of first node 3 are proximate to the traces of second node 4, a rib 12 protrudes outward beyond and intermediate the exterior surfaces of the traces, isolating them from each other. To electrically bridge nodes 3 and 4, the user's hand needs only make contact with at least one trace from first node 3 and at least one trace from second node 4. These embodiments increase the number of points where first node 3 is proximate to second node 4 and thus increases the number of activation points for flashlight 1. This minimizes or eliminates the possibility of gripping flashlight 1 without activating it. In the embodiments shown, first and second nodes 3 and 4 are also disposed about an area that extends over at least 80%, and preferably 80–90% of non-conductive housing 2. Due to the large area of nodes 3 and 4 and the increase in activation points, it is virtually impossible for the user to pick up flashlight 1 without activating it. These embodiments are well suited for emergency purposes, for example, they could be mounted in hotel rooms for use during a fire or power outage.

FIG. 5 depicts flashlight 1 similar to FIG. 6 but the traces of nodes 3 and 4 wrap around and up non-conductive housing 2. This version has the benefit of reducing the number of electrical connections below the surface of non-conductive housing 2. FIGS. 5 and 6 show the traces of nodes 3 and 4 in simple patterns. An alternative pattern could easily have the traces of nodes 3 and 4 disposed along the elongate axial length of flashlight 1. The number and pattern of the traces is virtually unlimited, allowing nodes 3 and 4 to form aesthetic or informative illustrations and indicia. These embodiments are well suited to using a conductive composition such as conductive ink to form first and second nodes 3 and 4.

Figure 7:
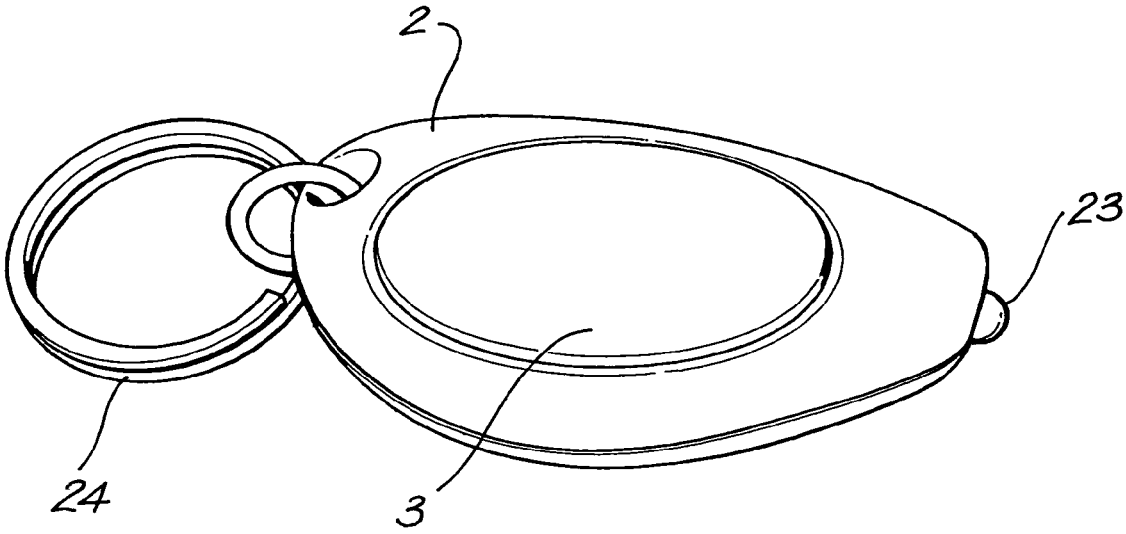
FIG. 7 is a side view of a key-chain light according to a fourth embodiment of the present invention.
Figure 8:
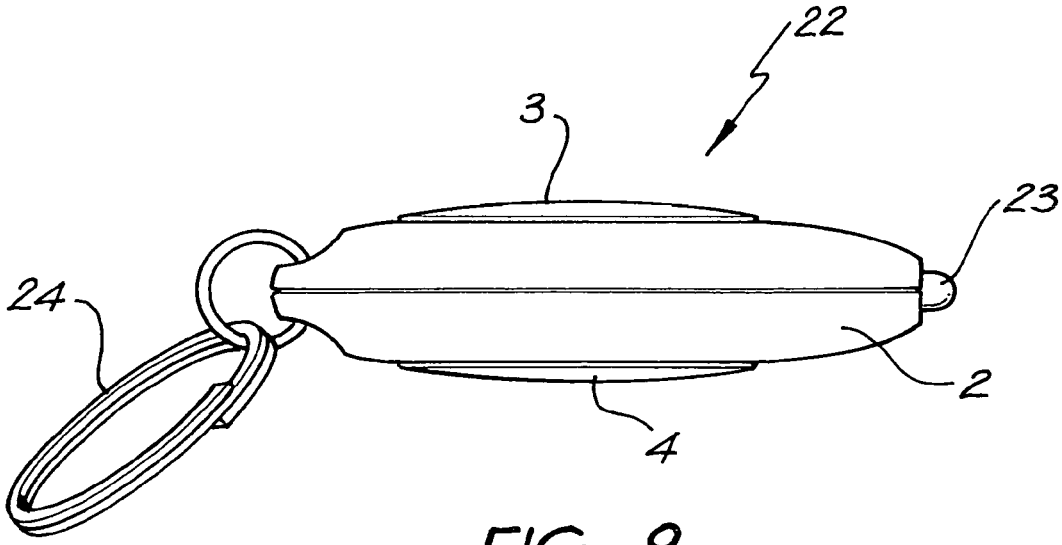
FIG. 8 is an elevation view of the key-chain light shown in FIG. 7.

FIGS. 7 and 8 highlight a further preferred embodiment wherein the portable lighting device is a key-chain light 22. In this embodiment, non-conductive housing 2 is saucer shaped with first and second nodes 3 and 4 disposed on opposite sides thereof. Key-ring assembly 24 is attached to non-conductive housing 2. First and second nodes 3 and 4 are preferably either electrically conductive or pressure sensitive to activate key-chain light 22 when grasped. In use, the normal grasping position is between the user's thumb and first finger. Disposing nodes 3 and 4 on opposite sides reduces the likelihood of inadvertent activation and thus removes the need for rib 12, even when conductive metal keys are attached to key-ring assembly 24. In this embodiment, batteries 13 (not shown) are smaller, such as coin type Lithium batteries or button cell batteries. Light bulb 17 is replaced with a smaller light emitting diode, LED 23.

Other, not shown embodiments are possible within the scope of the present invention. In a preferred, not shown embodiment, control circuit 21 may consist in various known electrical configurations. For example, the object that electrically bridges first and second nodes 3 and 4 may be required to have at least a predetermined minimum resistance for control circuit 21 to activate flashlight 1. An appropriate value for the predetermined minimum resistance might be one slightly lower than that expected of a wet user's hand when fully grasping first and second nodes 3 and 4 but higher than the resistance of common metallic conductors.

Control circuit 21 may also extend the lifetime of battery 13 by automatically turning flashlight 1 off when control circuit 21 senses a predetermined shutdown condition. For example, one predetermined shutdown condition could correspond to inadvertent activation scenarios such as when flashlight 1 is stored in a drawer against a conductive object. The corresponding predetermined shutdown condition is that first and second nodes 3 and 4 have been continuously electrically bridged for longer than a predetermined first time interval, for example 5 minutes. Another predetermined shutdown condition could correspond to inadvertent activation occurring when flashlight 1 is transported in a bag with conductive objects like keys or coins that repetitively make and brake contact with first and second nodes 3 and 4. Various shutdown conditions may be determined empirically and then implemented via control circuit 21.

In a further embodiment, at least one auxiliary node that is conductive or pressure sensitive is disposed on an external surface of non-conductive housing 2. The user may selectively abut a predetermined combination of the auxiliary nodes and first and second node 3 and 4 to control optional features, such as varying light intensity. To enable variable light intensity, control circuit 21 may be adapted in a similar configuration as described in U.S. Pat. No. 6,388,390 (Rachwal). Control circuit 21 may just as easily create a strobe effect, flashing light bulb 17 on and off based on the combination of nodes abutted.

In a further preferred embodiment, conventional mechanical means may be used to determine the operating state of flashlight 1 once it is activated via first and second nodes 3 and 4. For example, a first position of the conventional mechanical means may be 'strobe', a second position 'on steady'. If the mechanical switch is set to 'strobe', flashlight 1 begins flashing as soon as a user's hand abuts first and second node 3 and 4. Likewise, conventional mechanical means could be used to vary the operating state of flashlight 1 such as variable light intensities, colors, patterns of flashing and the like. The conventional mechanical means may also be used to override the touch sensitive nodes, such that flashlight 1 remains 'on' or 'off' despite whether any other nodes have been abutted. The conventional mechanical means may include pushbuttons, slide switches, and rheostats and may be formed integral to pre-existing components of flashlight 1. For example, a rheostat could be formed from the position of lens ring 6 relative to the rest of non-conductive housing 2. In these embodiments, control circuit 21 implements the various operational states by determining the condition of first and second nodes 3 and 4 and the conventional mechanical means and then allowing the appropriate amount and pattern of electrical current to flow through light bulb 17.

In a further preferred embodiment, the conductive material used to make first and second nodes 3 and 4 is conductive metal. The conductive metal would preferably be stamped and formed sheet metal fixed to the first and second side portions 8 and 9 of the non-conductive housing 2. Alternatively, first and second nodes 3 and 4 are made from conductive compositions, such as conductive ink, applied to external surfaces of non-conductive housing 2. Any suitable conductive composition, such as those taught in U.S. Pat. No. 5,973,420 or U.S. Pat. No. 5,455,749 could be used. This alternative embodiment is advantageous in its ease of manufacture and flexibility in fabricating variations to first and second nodes 3 and 4.

In a further preferred embodiment, first and second nodes 3 and 4 may be fabricated from touch sensitive film. The touch sensitive film may consist of a pressure sensitive film or a touch sensitive membrane switch, both familiar to one skilled in the prior art. In this embodiment, control circuit 21 senses when pressure is exerted on both first and second nodes 3 and 4 and consequently allows electric current to flow from batteries 13 through light bulb 17. In this embodiment rib 12 still helps prevent inadvertent activation by preventing linear portions of objects from simultaneously exerting pressure on both first and second nodes 3 and 4. In alternative embodiments, nodes 3 and 4 are disposed on opposite sides of flashlight 1, such that rib 12 is not necessary. A key advantage of this embodiment is that the flashlight is useable by someone wearing non-conductive gloves.

In a further not shown preferred embodiment, flashlight 1 is a laser pointer portable lighting device. In this embodiment, a laser emitter replaces light bulb 17 as the illumination source and is powered by appropriately sized batteries 13. Non-conductive housing 2 may be scaled appropriately to the laser emitter and batteries 13 used.

Further, not shown preferred embodiments of flashlight 1 exist for each of the standard battery sizes, for example 2AA, 4D, etc. Such embodiments may be made by simply manufacturing a shape and configuration for flashlight 1 that corresponds to the intended battery size. For example, 2AA battery embodiments are simply smaller in length and narrower than the embodiments shown in FIGS. 1–6.

A further preferred not shown embodiment is adapted to allow recharging of batteries 13 and includes a recharging base connectable to an installed power supply. In this embodiment, flashlight 1 includes electrical terminals adapted to contact corresponding terminals on the recharging base when flashlight 1 is seated in the recharging base.

Key advantages of the above embodiments of portable lighting devices include: 1) requires limited dexterity to activate; 2) does not require the user to locate an activation site on the device; and 3) avoids accidental activation during storage or periods of non-use.

The foregoing describes only preferred embodiments of the present invention and modifications, obvious to those skilled in the art, can be made thereto without departing from the scope of the present invention.

We claim:

1. A portable lighting device comprising:

a non-conductive housing having at least one rib protruding outward from said non-conductive housing;

an electric power source;

a light source adapted to illuminate when electric current flows through said light source;

two spaced apart nodes disposed on external surfaces of said non-conductive housing adjacent to and on either side of said rib, wherein said rib protrudes beyond said two spaced apart nodes such that a linear portion of an object can not simultaneously contact both of said two spaced apart nodes;

said portable lighting device adapted to allow electric current to flow from said power source through said light source when said two spaced apart nodes are both abutted by a user's hand as said user grasps said portable lighting device.

2. The portable lighting device of claim 1, wherein each of said two spaced apart nodes is comprised of an array of traces disposed on the surface of, and electrically connected by connections disposed internal to, said non-conductive housing, and wherein one of said at least one rib is disposed between proximate traces of said two spaced apart nodes to minimize inadvertent activation of said portable lighting device.

3. The portable lighting device of claim 1, wherein each of said two spaced apart nodes are disposed on different graspable sides of said non-conductive housing, such that said two spaced apart nodes are abutted from different directions by said user's hand as it surrounds and grasps said portable lighting device.

4. The portable lighting device of claim 1, wherein said two spaced apart nodes are disposed along the normal grasping position of said non-conductive housing, such that when said user places said user's hand in said normal grasping position, said user's hand abuts said two spaced apart nodes without further manipulation required to activate said portable lighting device.

5. The portable lighting device of claim 1, wherein said rib is disposed axially along said portable lighting device.

6. The portable lighting device of claim 1, wherein said two spaced apart nodes are disposed about an area that extends over at least 5% of said non-conductive housing.

7. The portable lighting device of claim 1, wherein said two spaced apart nodes are disposed about an area that extends over at least 20% of said non-conductive housing.

8. The portable lighting device of claim 1, wherein said two spaced apart nodes are disposed about an area that extends over at least 40% of said non-conductive housing.

9. The portable lighting device of claim 1, wherein said two spaced apart nodes are disposed about an area that extends over at least 60% of said non-conductive housing.

10. The portable lighting device of claim 1, wherein said two spaced apart nodes are disposed about an area that extends over at least 80% of said non-conductive housing.

11. The portable lighting device of claim 1, wherein at least one of said two spaced nodes is disposed about an area that extends over a substantial portion of the axial length of said non-conductive housing.

12. The portable lighting device of claim 11, wherein said area extends over at least 60% of the axial length of said non-conductive housing.

13. The portable lighting device of claim 11, wherein said area extends over at least 70% of the axial length of said non-conductive housing.

14. The portable lighting device of claim 1, wherein the outer surfaces of said two spaced apart nodes form a plurality of gripping ridges.

15. The portable lighting device of claim 1, wherein said two spaced apart nodes are compliant grips of said portable lighting device.

16. The portable lighting device of claim 1, wherein said two spaced apart nodes are conductive and said portable lighting device is adapted to allow electric current to flow from said power source through said light source when said two spaced apart nodes are electrically bridged through the conductive medium of said user's hand as said user grasps said portable lighting device.

17. The portable lighting device of claim 16, wherein said two spaced apart nodes are made from a conductive material and subsequently affixed to said external surfaces of said non-conductive housing.

18. The portable lighting device of claim 17, wherein said conductive material is a conductive metal.

19. The portable lighting device of claim 16, wherein said two spaced apart nodes are made from a conductive composition applied to said external surfaces of said non-conductive housing.

20. The portable lighting device of claim 19, wherein said conductive composition is a conductive ink.

21. The portable lighting device of claim 16, wherein a control circuit allows electric current to flow from said power source through said light source when said two spaced apart nodes are electrically bridged.

22. The portable lighting device of claim 21, wherein said control circuit allows electric current to flow from said power source through said light source when said two spaced apart nodes are electrically bridged by a conductive medium having at least a predetermined minimum resistance.

23. The portable lighting device of claim 22, wherein said predetermined minimum resistance is lower than the resistance through a wet human hand and higher than the resistance through a metallic conductor.

24. The portable lighting device of claim 21, wherein said control circuit automatically prevents electric current from flowing from said power source through said light source when a predetermined shutdown condition is determined by said control circuit.

25. The portable lighting device of claim 24, wherein said predetermined shutdown condition is that said two spaced apart nodes have been continuously electrically bridged for longer than a predetermined time interval.

26. The portable lighting device of claim 21, wherein said portable lighting device further comprises at least one auxiliary node disposed on an external surface of said non-conductive housing.

27. The portable lighting device of claim 26, wherein said control circuit allows said user to vary the light intensity of said portable lighting device by electrically bridging said at least one auxiliary node with at least one node selected from: said two spaced apart nodes and further auxiliary nodes.

28. The portable lighting device of claim 26, wherein said control circuit allows said user to select between continuous activation and strobe activation of said portable lighting device by electrically bridging said at least one auxiliary node with at least one node selected from: said two spaced apart nodes and further auxiliary nodes.

29. The portable lighting device of claim 21, further comprising at least one conventional mechanical means movable between a first and at least a second position, wherein said control circuit determines the operating state of said portable lighting device based on said conventional mechanical means when said portable lighting device is activated.

30. The portable lighting device of claim 1, wherein said two spaced apart nodes are made from touch sensitive film and said portable lighting device is adapted to allow electric current to flow from said power source through said light source when said user's hand grasps both of said two spaced apart nodes.

31. The portable lighting device of claim 30, wherein a control circuit allows electric current to flow from said power source through said light source when pressure is exerted on both of said two spaced apart nodes.

32. The portable lighting device of claim 31, wherein said control circuit automatically prevents electric current from flowing from said power source through said light source when a predetermined shutdown condition is determined by said control circuit.

33. The portable lighting device of claim 32, wherein said predetermined shutdown condition is that pressure has been exerted on both of said two spaced apart nodes continuously for longer than a predetermined time interval.

34. The portable lighting device of claim 31, wherein said portable lighting device further comprises at least one auxiliary node disposed on an external surface of said non-conductive housing.

35. The portable lighting device of claim 34, wherein said control circuit allows said user to vary the light intensity of said portable lighting device by exerting pressure on said at least one auxiliary node.

36. The portable lighting device of claim 34, wherein said control circuit allows said user to select between continuous activation and strobe activation of said portable lighting device by exerting pressure on said at least one auxiliary node.

37. The portable lighting device of claim 31, further comprising at least one conventional mechanical means movable between a first and at least a second position, wherein said control circuit determines the operating state of said portable lighting device based on said conventional mechanical means when said portable lighting device is activated.

38. The portable lighting device of claim 1, wherein said portable lighting device is a flashlight.

39. The portable lighting device of claim 1, wherein said portable lighting device is a key-chain light.

40. The portable lighting device of claim 1, wherein said portable lighting device is a laser pointer.

41. The portable lighting device of claim 1, wherein said portable lighting device is rechargeable.

42. A portable lighting device comprising:

a non-conductive housing;

an electric power source;

a light source adapted to illuminate when electric current flows through said light source;

two spaced apart nodes disposed on different spaced apart external surfaces of said non-conductive housing, such that said two spaced apart nodes are abutted from different directions by a user's hand as it surrounds and grasps said portable lighting device;

said portable lighting device adapted to allow electric current to flow from said power source through said light source when said two spaced apart nodes are abutted by said user's hand as said user grasps said portable lighting device activating said portable lighting device without further manipulation required by said user.

43. A portable lighting device comprising:

a non-conductive housing;

an electric power source;

a light source adapted to illuminate when electric current flows through said light source;

two nodes disposed on external surfaces of said non-conductive housing;

said portable lighting device adapted to allow electric current to flow from said power source through said light source when both of said two nodes are abutted by a user's hand, and wherein whenever said user grasps said portable lighting device, both of said two nodes are abutted, activating said portable lighting device without further manipulation required by said user.

* * * * *